US009113669B1

(12) United States Patent
Kleinman

(10) Patent No.: US 9,113,669 B1
(45) Date of Patent: Aug. 25, 2015

(54) HAIR EXTENSION DEVICE AND RELATED METHODS OF MANUFACTURE

(71) Applicant: Michael Kleinman, Rydal, PA (US)

(72) Inventor: Michael Kleinman, Rydal, PA (US)

( * ) Notice: Subject to any disclaimer, the term of this patent is extended or adjusted under 35 U.S.C. 154(b) by 0 days.

(21) Appl. No.: 14/120,166

(22) Filed: May 1, 2014

(51) Int. Cl.
*A41G 3/00* (2006.01)
*A41G 5/00* (2006.01)

(52) U.S. Cl.
CPC ..... *A41G 5/0046* (2013.01); *A41G 5/0073* (2013.01); *A41G 5/0093* (2013.01); *A41G 5/0053* (2013.01)

(58) Field of Classification Search
CPC ..... A41G 3/0075; A41G 3/00; A41G 3/008; A41G 3/0033; A41G 3/0083; A41G 5/00; A41G 5/004; A41G 5/0046; A41G 5/0053; A41G 5/006; A41G 5/0073; A41G 5/0093
USPC ..... 132/201, 200, 212, 53–56, 273, 275, 132/105, 130; 2/DIG. 11, 171.8, 209.13, 2/209.14; D28/92, 93
See application file for complete search history.

(56) References Cited

U.S. PATENT DOCUMENTS

| | | | | | |
|---|---|---|---|---|---|
| 703,531 | A * | 7/1902 | Brown | 2/171 |
| 1,519,107 | A * | 12/1924 | Breslauer | 132/53 |
| 1,775,209 | A * | 9/1930 | Oppenheim | 132/105 |
| 2,011,194 | A * | 8/1935 | Eisler | 132/273 |
| 4,600,029 | A * | 7/1986 | Ueberschaar | 132/53 |
| 5,230,355 | A * | 7/1993 | Weingrod | 132/275 |
| 5,551,452 | A * | 9/1996 | Barlow | 132/54 |
| 5,899,211 | A * | 5/1999 | Brown | 132/201 |
| 5,915,532 | A * | 6/1999 | Williams | 2/171 |
| 6,076,532 | A * | 6/2000 | Thomas et al. | 132/273 |
| 6,405,736 | B2 * | 6/2002 | Townsend | 132/201 |
| 6,830,054 | B1 * | 12/2004 | Ross-Kuehn | 132/201 |
| 6,837,249 | B2 * | 1/2005 | Smith | 132/201 |
| 7,320,327 | B2 * | 1/2008 | Frazier | 132/201 |
| 7,610,921 | B2 * | 11/2009 | Gold | 132/53 |
| 7,753,057 | B2 * | 7/2010 | Kallabat et al. | 132/201 |
| 7,854,233 | B2 * | 12/2010 | Freelove | 132/201 |
| 2002/0014249 | A1 * | 2/2002 | Ott | 132/201 |
| 2005/0098191 | A1 * | 5/2005 | Frazier | 132/201 |
| 2005/0268932 | A1 * | 12/2005 | Gold | 132/201 |
| 2006/0169297 | A1 * | 8/2006 | Gill et al. | 132/201 |
| 2007/0157944 | A1 * | 7/2007 | Catron et al. | 132/201 |
| 2008/0072920 | A1 * | 3/2008 | Ladue | 132/201 |
| 2008/0178902 | A1 * | 7/2008 | Moeszinger | 132/273 |
| 2008/0257369 | A1 * | 10/2008 | Poole | 132/53 |
| 2008/0302382 | A1 * | 12/2008 | Wang | 132/273 |
| 2009/0101162 | A1 * | 4/2009 | Hsu | 132/273 |
| 2009/0260649 | A1 * | 10/2009 | Sakurai et al. | 132/201 |
| 2010/0065078 | A1 * | 3/2010 | Reece | 132/54 |
| 2010/0154812 | A1 * | 6/2010 | Westerman Holstijn | 132/54 |
| 2011/0017228 | A1 * | 1/2011 | Freelove | 132/201 |
| 2011/0094530 | A1 * | 4/2011 | Sedillo-Beadell | 132/201 |
| 2013/0167858 | A1 * | 7/2013 | Lee | 132/201 |
| 2015/0013710 | A1 * | 1/2015 | Buzaglo et al. | 132/201 |

* cited by examiner

*Primary Examiner* — Vanitha Elgart
(74) *Attorney, Agent, or Firm* — Dan M. DeLaRosa

(57) ABSTRACT

A hair extension device is provided, the device comprising: a first strip of polyurethane having a first surface; a plurality of hair having opposing ends, the first ends are sewn together and attached to the first surface of the first panel, the second ends being freely movable; a second strip of polyurethane placed over the first ends of the plurality of hair and over the first panel and then heat sealed to form a panel; at least two apertures situated on opposing ends of the panel; and a string attached and secured to the apertures on the panels.

20 Claims, 4 Drawing Sheets

HAIR EXTENSION DEVICE AND RELATED METHODS OF MANUFACTURE

BACKGROUND OF THE INVENTION

Field of the Invention

The present invention relates to a hair extension device and more specifically, a method for manufacturing a hair extension device.

SUMMARY OF THE INVENTION

In one embodiment, the present invention relates to a hair extension device manufactured by a process comprising: providing at least two strips of polyurethane, a plurality of hair with opposing ends, at least one string and plastic beads; sewing a first end of the plurality of hair; placing the sewn end of the plurality of hair over a first strip of polyurethane; placing a second strip of polyurethane over the sewn end of the plurality of hair and the first strip; heat sealing the sewn end of said plurality of hair onto the first and second strips to form a panel, the panel having opposing ends; punching an aperture on each of the opposing ends of the panel; looping and securing the string to the plastic beads; and inserting the string into the apertures on the panel and securing the string to the panel with sewn hair using the beads to thereby form a hair extension device. In another embodiment, the second end of the plurality of hair is freely moving and unattached to one another.

In still another embodiment, the plurality of hair is blended together, using multiple colors to achieve a natural blend of tones prior to being sewn. In yet another embodiment, the plurality of hair is cut to a desired length prior to being sewn. In still yet another embodiment, the strips are heat sealed using a heat pressing machine. In a further embodiment, the panel is cut to a desired length prior to punching an aperture on the opposing ends.

In another further embodiment, the string is an elastic monofilament. In yet a further embodiment, the process further comprises making multiple pressed panels to create layers of hair.

In still a further embodiment, the present invention relates to a hair extension device comprising: a first strip of polyurethane having a first surface; a plurality of hair having opposing ends, the first ends are sewn together and attached to the first surface of the first strip, the second ends are freely movable; a second strip of polyurethane placed over the first end of the plurality of hair and over the first strip and then heat sealed to form a panel; at least two apertures situated on opposing ends of the panel; and a string attached and secured to the apertures on the panel.

In still yet a further embodiment, the device is applied to a wearer by placing the string over the wearer's chin with the plurality of hair. In another embodiment, the wearer then brings their own hair over the panel and the plurality of hair. In yet another embodiment, the wearer then moves the string to the top of the crown of the wearer's head. In still another embodiment, the device is adjusted and lies flat on the wearer's head with the plurality of hair of the device blending with wearer's own hair.

In still yet another embodiment, the present invention relates to a method of manufacturing a hair extension device, and the method comprising: providing a plurality of strands of hair aligned with one another to form opposing ends, and at least one string; placing a first end of the plurality of hair over a first strip of polyurethane; placing a second strip of polyurethane over the first end of the plurality of hair and the first strip; heat sealing the first end of the plurality of hair onto the first and second strips to form a panel, and the panel has opposing ends; punching an aperture on each of the opposing ends of the panel; securing the string to the apertures on the panel to thereby form a hair extension device.

In a further embodiment, the method further comprises making multiple pressed panels to create layers of hair. In another further embodiment, the method further comprises the step of using a plastic bead to secure the string to the panel.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
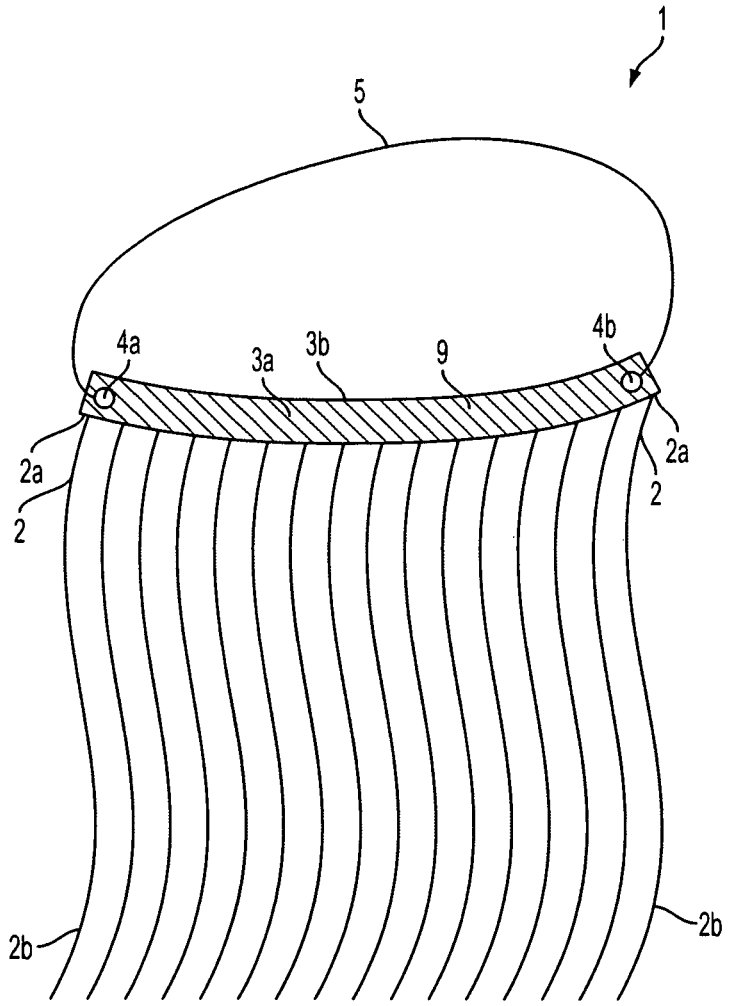
FIG. 1 is a side perspective view of hair extension device of the present invention.

FIG. 1 illustrates a hair extension device 1 comprising: a first strip of polyurethane 3*b*; a plurality of hair 2 having opposing ends, 2*a* and 2*b* respectively, the first ends 2*a* are sewn together and attached to the first strip 3*b*; the second ends 2*b* are freely movable and a second strip 3*a* of polyurethane placed over the first ends 2*a* of the plurality of hair 2 and over the first strip 3*b* and then heat sealed to form a panel 9; at least two apertures, 4*a* and 4*b* respectively, situated on opposing ends of the panel 9; and a string 5 attached and secured to the apertures 4*a* and 4*b* on the panel 9.

Figure 2:
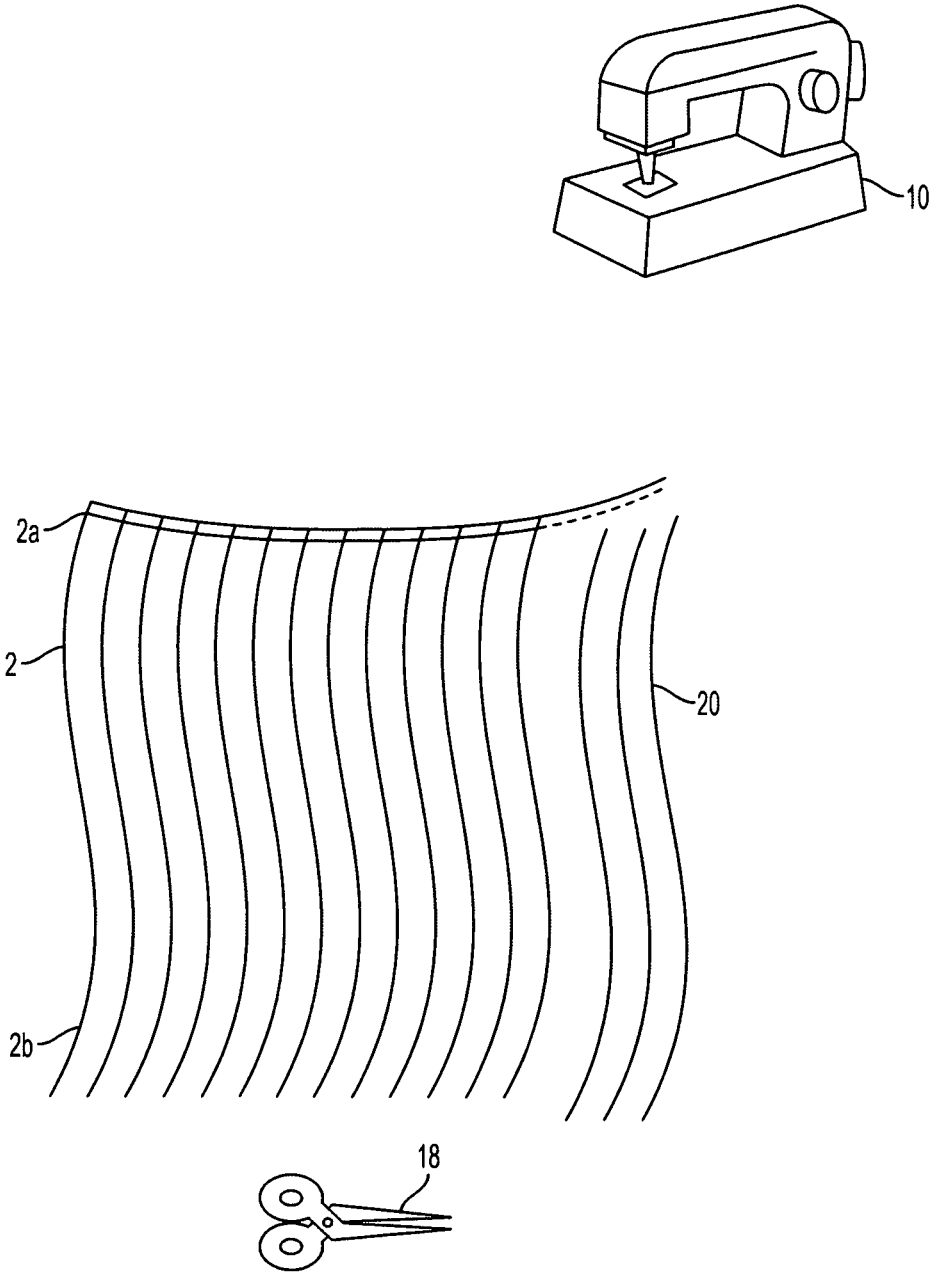
FIG. 2 is a perspective view of the plurality of hair being cut to a desired length and sewn on one of their ends.
Figure 3:
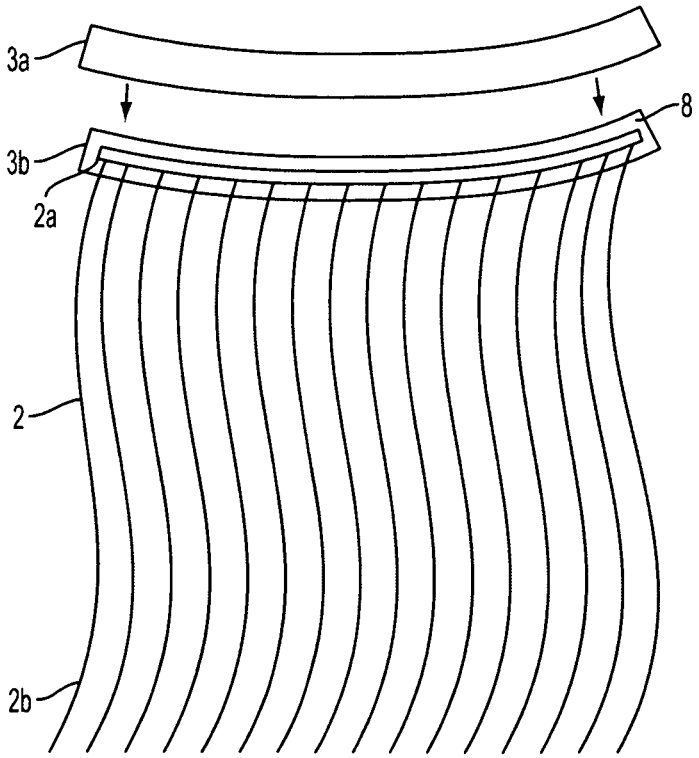
FIG. 3 is an exploded view of the device showing the plurality of hair and the two strips of polyurethane.
Figure 4:
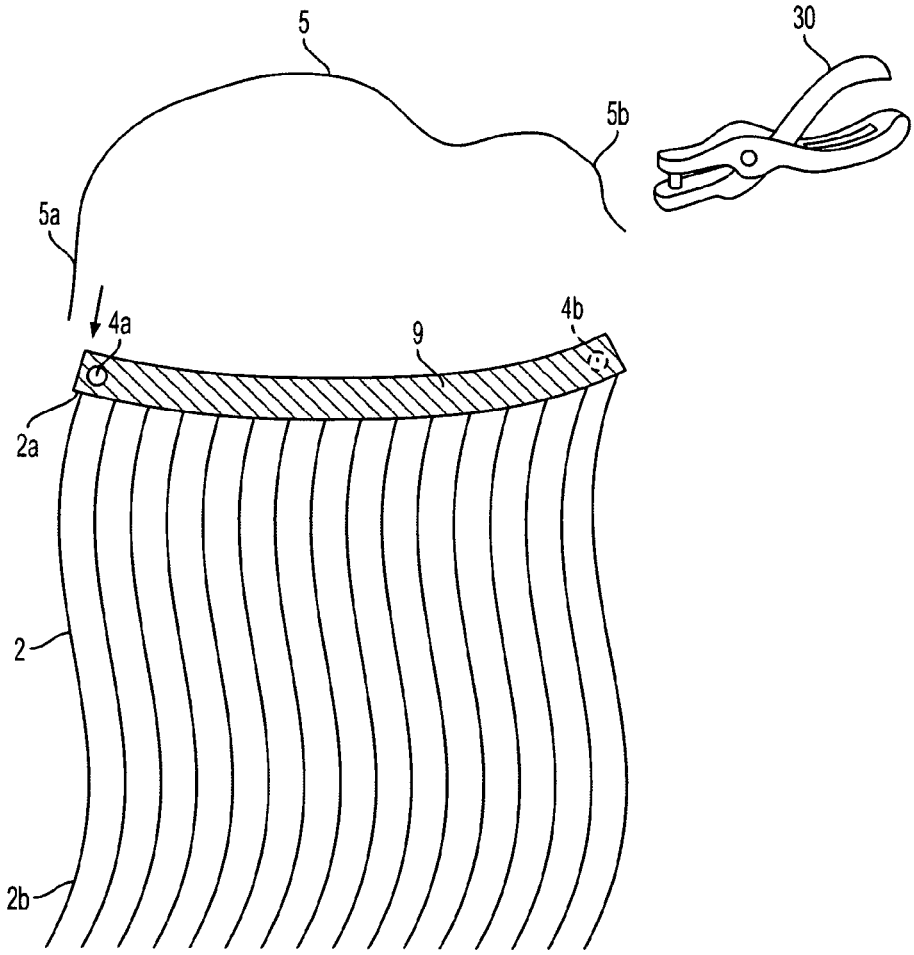
FIG. 4 is a perspective view of the assembly of the device, in particular, the creation of a hole and attachment of the string.

FIG. 2 depicts how the plurality of hair 2 is cut to a desired length using a cutting device 18 and the first end 2*a* of the plurality of hair 2 is sewn together using a sewing device 10. FIG. 3 shows how the sewn end 2*a* of the plurality of hair 2 is placed on a surface 8 of the first strip 3*b* of polyurethane. A second strip 3*a* of polyurethane is then place over the first strip 2*b* and is heat sealed to form a panel 9. FIG. 4 illustrates how at least two apertures, 4*a* and 4*b* respectively, are formed on the panel 9 using a hole punching device 30. A string 5 having opposing ends, 5*a* and 5*b* respectively, are attached to apertures 4*a* and 4*b*.

It is noted that other materials besides polyurethane may be used to form the panel 9. It is further noted that the hair extension device 1 of the present invention can be manufactured by hand or by machine. The hair can be human, animal or synthetic.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A hair extension device manufactured by a process comprising:

providing at least two strips of polyurethane, a plurality of hair with opposing ends, at least one string and plastic beads;

sewing a first end of said plurality of hair;

placing said sewn end of said plurality of hair over a first strip of polyurethane;

placing a second strip of polyurethane over said sewn end of said plurality of hair and said first strip;

heat sealing said sewn end of said plurality of hair onto said first and second strips to form a panel, said panel having opposing ends;

punching an aperture on each of said opposing ends of said panel;

looping and securing said string to said plastic beads; and inserting said string into said apertures on said panel and securing said string to said panel with sewn hair using said beads to thereby form a hair extension device, said string forming a single loop and being adapted to fit about the crown of a wearer's head and be hidden in the wearer's own hair.

2. The process of claim 1 wherein said second end of said plurality of hair is freely moving and unattached to one another.

3. The process of claim 1 wherein said plurality of hair is blended together, using multiple colors to achieve a natural blend of tones prior to being sewn.

4. The process of claim 1 wherein said plurality of hair is cut to a desired length prior to being sewn.

5. The process of claim 1 wherein said strips are heat sealed using a heat pressing machine.

6. The process of claim 1 wherein said panel is cut to a desired length prior to punching an aperture on said opposing ends.

7. The process of claim 1 wherein said string is an elastic monofilament.

8. The process of claim 1 further comprising making multiple pressed panels to create layers of hair.

9. A hair extension device comprising:

a first strip of polyurethane having a first surface;

a plurality of hair having opposing ends, said first ends being sewn together and attached to said first surface of said first strip, said second ends being freely movable;

a second strip of polyurethane placed over said first end of said plurality of hair and over said first strip and then heat sealed to form a panel;

said panel having a first end and an opposing second end with a first aperture punched through said first end and a second aperture punched through said second end; and an elastic monofilament string inserted through and secured to each of said first and second apertures on said panel wherein said string forms a single loop that is adapted to fit about the crown of a wearer's head and be hidden by the wearer's own hair.

10. The device of claim 9 wherein said plurality of hair is blended together, using multiple colors to achieve a natural blend of tones prior to being sewn.

11. The device of claim 9 wherein said plurality of hair is cut to a desired length prior to being sewn.

12. The device of claim 9 wherein said strips are heat sealed using a heat pressing machine.

13. A method of manufacturing a hair extension device, said method comprising:

providing a plurality of strands of hair aligned with one another to form opposing ends, and at least one string;

placing a first end of said plurality of hair over a first strip of polyurethane;

placing a second strip of polyurethane over said first end of said plurality of hair and said first strip;

heat sealing said first end of said plurality of hair onto said first and second strips to form a panel, said panel having opposing ends;

punching an aperture on each of said opposing ends of said panel;

inserting into and securing said string to said apertures on said panel to thereby form a hair extension device, said string forming a single loop and being adapted to fit about the crown of a wearer's head and be hidden in the wearer's own hair.

14. The method of claim 13 wherein said plurality of hair is blended together, using multiple colors to achieve a natural blend of tones prior to being heat sealed onto said panel.

15. The method of claim 13 wherein said plurality of hair is cut to a desired length prior to being heat sealed onto said panel.

16. The method of claim 13 wherein said strips are heat sealed using a heat pressing machine.

17. The method of claim 13 wherein said panel is cut to a desired length prior to punching an aperture on said opposing ends.

18. The method of claim 13 wherein said string is an elastic monofilament.

19. The method of claim 13 further comprising making multiple pressed panels to create layers of hair.

20. The method of claim 13 further comprising the step of using a plastic bead to secure said string to said panel.

* * * * *